US006168478B1

(12) United States Patent
Daoud

(10) Patent No.: US 6,168,478 B1
(45) **Date of Patent: *Jan. 2, 2001**

(54) SNAP TYPE RETENTION MECHANISM FOR CONNECTOR TERMINALS

(75) Inventor: Bassel Hage Daoud, Parsippany, NJ (US)

(73) Assignee: Lucent Technologies, Inc., Murray Hill, NJ (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/143,203

(22) Filed: Aug. 28, 1998

(51) Int. Cl.[7] ..... H01R 13/432

(52) U.S. Cl. ..... 439/746; 439/404; 439/872; 439/854

(58) Field of Search ..... 439/744, 746, 439/747, 748, 749, 872, 884, 404

(56) References Cited

U.S. PATENT DOCUMENTS 3,412,369 * 11/1968 Fox ..... 439/747
4,174,877 * 11/1979 Foederer ..... 339/97
4,241,976 * 12/1980 Oliver et al. ..... 339/278
4,265,504 * 5/1981 Burns ..... 339/97
4,564,254 * 1/1986 Van Alst ..... 339/99
4,701,004 * 10/1987 Yohn ..... 439/781
5,092,790 * 3/1992 Justiano et al. ..... 439/351
5,147,227 * 9/1992 Yurko ..... 439/733
5,376,023 * 12/1994 Matsuyama ..... 439/746
5,389,013 * 2/1995 Kourimski ..... 439/746
5,425,656 * 6/1995 Wakata ..... 439/595
5,538,445 * 7/1996 Grzybowski et al. ..... 439/752
5,588,877 * 12/1996 Davis et al. ..... 439/660
5,664,969 * 9/1997 Peterson et al. ..... 439/746

* cited by examiner

*Primary Examiner*—Paula Bradley
*Assistant Examiner*—Truc Nguyen
(74) *Attorney, Agent, or Firm*—Howard C. Miskin; Gloria Tsui-Yip

(57) ABSTRACT

The invention discloses an insulation displacement connector terminal having a snap type retention mechanism which securely retains the terminal within its cooperative housing. The terminal has a plurality of flexible tabs protruding from the surface of the terminal. While the terminal is being inserted into its housing, the tabs deflect to pass through the entry slot of the housing. Upon full insertion of the terminal within its housing, the tabs snap back to its original protruded position, wedging the terminal against the entry slot.

7 Claims, 7 Drawing Sheets

FIG. 6
FIG. 6A
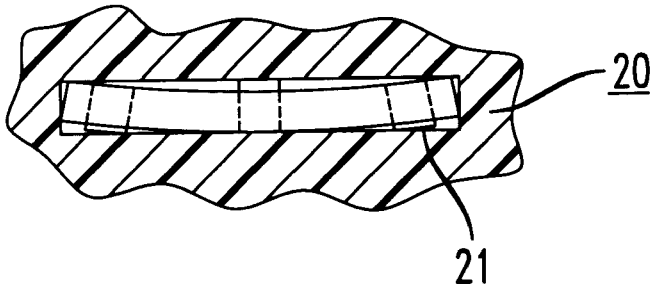
FIG. 6B
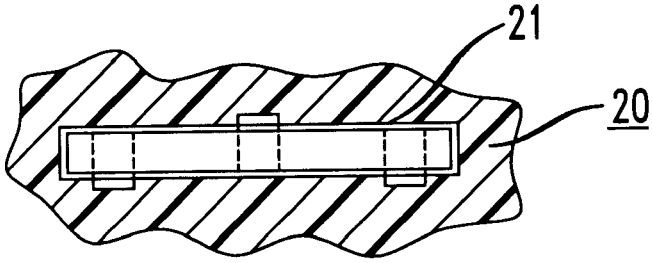

SNAP TYPE RETENTION MECHANISM FOR CONNECTOR TERMINALS

CROSS REFERENCE TO RELATED APPLICATION

This application is related to U.S. Patent Application having Ser. No. 09/143,202 and also identified by Docket Number Daoud 124 and is assigned to the same assignee as the present invention.

FIELD OF THE INVENTION

The invention relates to an insulation displacement connector terminal which facilitates the installation of the terminal within a cooperative housing and securely retains it in the housing.

BACKGROUND OF THE INVENTION

Insulation Displacement Connector (IDC) terminals are widely used in different types of application for connecting wires; particularly in the telecommunication industry. An IDC terminal eliminates the need to strip the insulation from a wire prior to making connection by providing a pair of tapered beams which pierce the insulation upon seating the wire between the beams of the IDC terminal. Hence, connection of an insulated wire can be accomplished in one step, which is both efficient and cost-effective.

There are two general types of IDC terminals, double-ended or single-ended. A double-ended IDC terminal has a pair of beams on each end; whereas a single-ended IDC terminal has a pair of beams on one end and a post on the opposite end for wire wrapped connections.

IDC terminals are fitted in channels or slots within a dielectric housing, such as plastic, to provide safe and secure connections between wires. For proper function of an IDC terminal, it is essential that IDC terminals are safely secured within such housing. Good retention of IDC terminals in the housing is necessary to sustain the force exerted upon the IDC terminals when wires are seated and snubbed between beams of the IDC terminals. Otherwise, IDC terminals may be displaced from the housing when compressive force of the wires are exerted upon the terminals without properly piercing the insulation and connecting the wires, causing performance failure.

A prior art single-ended IDC terminal is held in entry slot of a cooperative housing with a pair of small barbs protruding on each side of the IDC terminal. During the insertion process of such an IDC terminal into its housing, the plastic housing where such barbs pass through is compressed due to the inflexibility of the barbs. Deformation of the plastic housing is permanent and may be excessive, resulting in a larger opening in the slot. The deformation of the plastic housing provides an avenue for the IDC terminal to move backward against the direction of insertion when force is exerted on the IDC terminal during the wire seating process. The disadvantage of such a prior art IDC terminal cannot be overcome by having larger sized barbs because deformation of the housing increased proportionally to the increase in the barb size, which would not improve the retention of the IDC terminal within the housing. To properly secure such prior art IDC terminal in its housing, a cooperative base is necessary to prevent the displacement of the IDC terminal from its housing.

Therefore, there is a need for an IDC terminal that can be inserted into a dielectric housing with little or no deformation of the housing, be securely fitted within such a housing to sustain the force exerted by the seating of wires without a cooperative unit and be inserted into its housing efficiently and in a cost-effective manner.

SUMMARY OF THE INVENTION

The invention provides a device that securely fits, in an efficient and cost-effective manner, in its cooperative housing to ensure proper inter-connection between wires.

The invention provides an insulation displacement connector (IDC) terminal that is securely retained within a cooperative housing by merely inserting the terminal into an entry slot of the housing, and which can sustain compressive force exerted on the terminal during seating of wires on the terminal without its displacement.

The IDC terminal of the present invention has a snap type retention system which comprises a plurality of flexible protrusions or tabs on one or both surfaces of the terminal. During insertion of the IDC terminal into an entry slot of the cooperative housing, the protruded tabs deflect and flex towards the surface of the terminal. Each tab exerts an opposing force upon the surface of the terminal, causing the terminal to arch. Upon full insertion of the terminal, the tabs snap back to its original position, allowing the terminal to return to a flattened state. The tabs are now wedged against the entry slots of the housing, which securely maintain the terminal in the housing. Hence, a separate cooperative base is not necessary to prevent displacement of the terminal from its housing during the wire seating process.

BRIEF DESCRIPTION OF THE DRAWINGS

FIG. 6, comprises of FIGS. 6A and 6B, illustrate the arching and un-arching of the terminal and the flexing and un-flexing of the tabs during and after the insertion process, respectively.

DETAILED DESCRIPTION OF THE PREFERRED EMBODIMENTS

Figure 1:
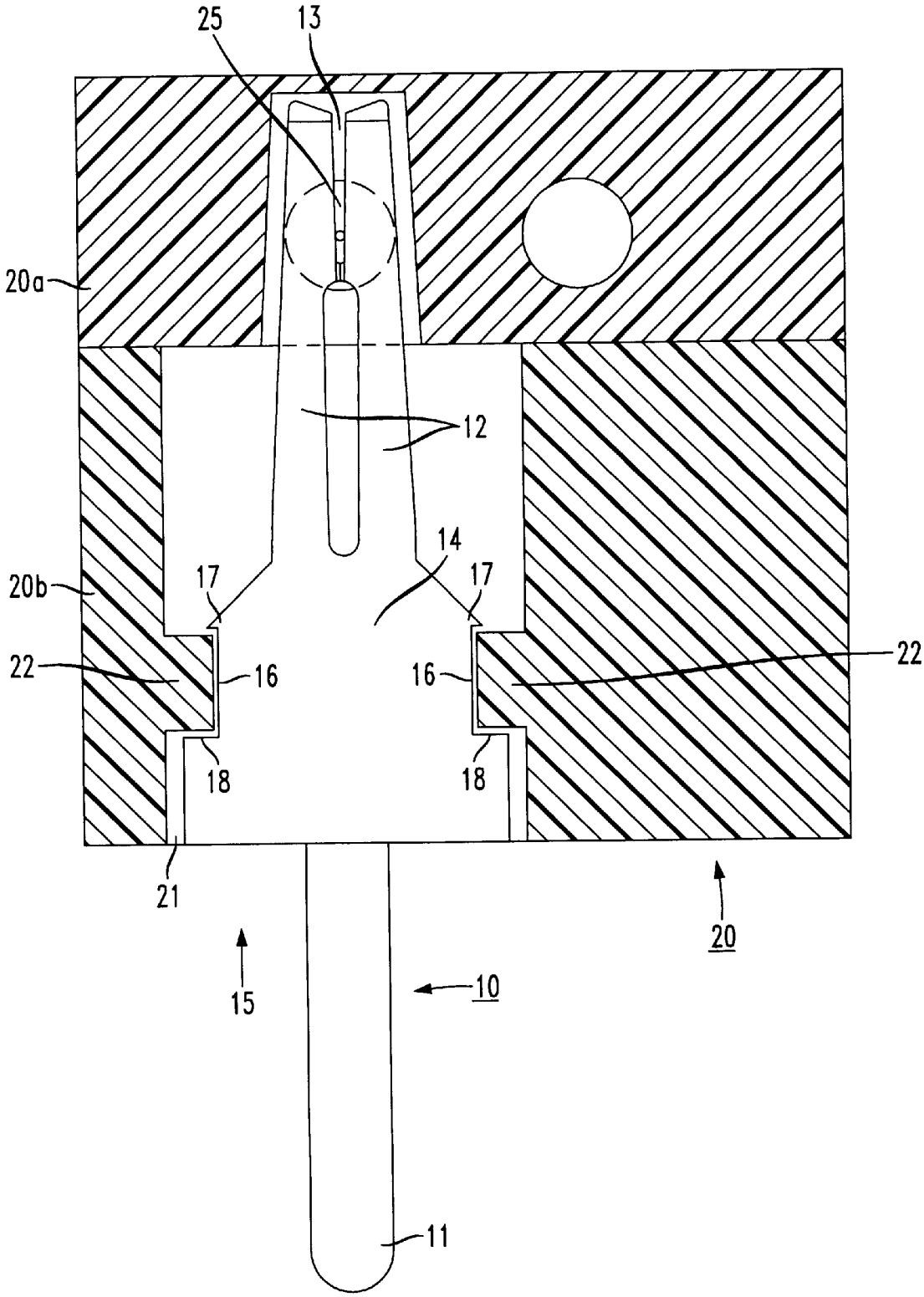
FIG. 1 PRIOR ART
FIG. 1 is a cross-sectional view of a cooperative housing with a prior art insulation displacement connector terminal utilizing side barbs to secure it within the housing.

With reference to the drawings, wherein the same reference number indicates the same element throughout, there is shown in FIG. 1 a cross-sectional view of a cooperative housing 20 with a prior art insulation displacement connector (IDC) terminal 10. Prior art terminal 10 is made of an electrically conducting material, whereas housing 20 is made of a dielectric material.

As shown in FIG. 1, cooperative housing 20 comprises a top portion 20*a* and a bottom portion 20*b*. Top portion 20*a* provides coverage and isolation of wire 25 inserted into IDC terminal 10 and bottom portion 20*b* provides an entry slot 21 for terminal 10.

Prior art IDC terminal 10 is a single-ended type having a post 11 for wire wrap connection on one end and a pair of cantilever beams 12, defining an elongated slot 13 therebetween, for snubbing and seating of wires, on the opposite end. Body 14 of prior art terminal 10 has a pair of side notches 16 for mating with a pair of tongues 22 extending into entry slot 21 of housing 20 for securing terminal 10 within housing 20. The pair of tongues 22 define a narrower portion of entry slot 21. The pair of side notches 16 are defined on one side by a pair of side barbs 17 and the other side by a wider portion 18 of body 14.

During the insertion process of the prior art terminal 10 into entry slot 21 of housing 20 in the direction of directional arrow 15, the pair of side barbs 17 is forced through the narrower portion of entry slot 21 until notches 16 engage tongues 22 and the wider portion 18 of body 14 makes contact with tongues 22. While prior art terminal 10 is inserted into its cooperative housing 20, side barbs 17 caused deformation of the wall of tongue 22 and widen the entry slot 21 between tongues 22. Thereby, providing minimal retention of prior art terminal 10 within housing 20, especially when force is applied to insert a wire 25 for snubbing and seating into terminal 10.

Figure 2:
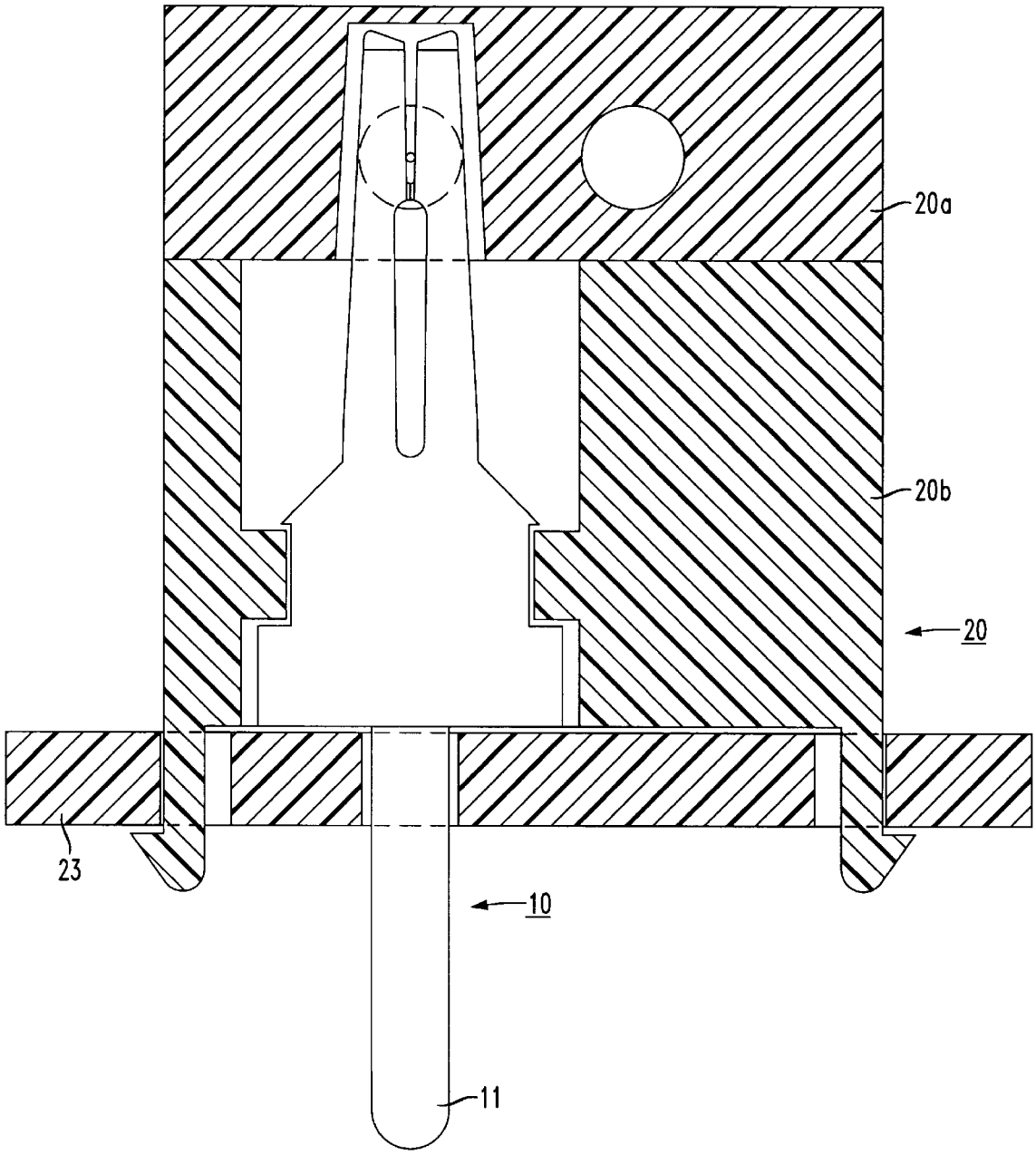
FIG. 2 PRIOR ART
FIG. 2 is a cross-sectional view of a cooperative housing with a prior art insulation displacement connector terminal utilizing side barbs, illustrating the necessity of a cooperative base.

To provide better retention of prior art IDC terminal 10 within housing 20, FIG. 2 shows the necessity of a cooperative base 23 adapted for use with housing 20 to prevent the displacement of terminal 10 from housing 20 during the snubbing process. The use of a cooperative base 23 increases the cost, time and effort in the assembly of the combined unit.

Figure 3:
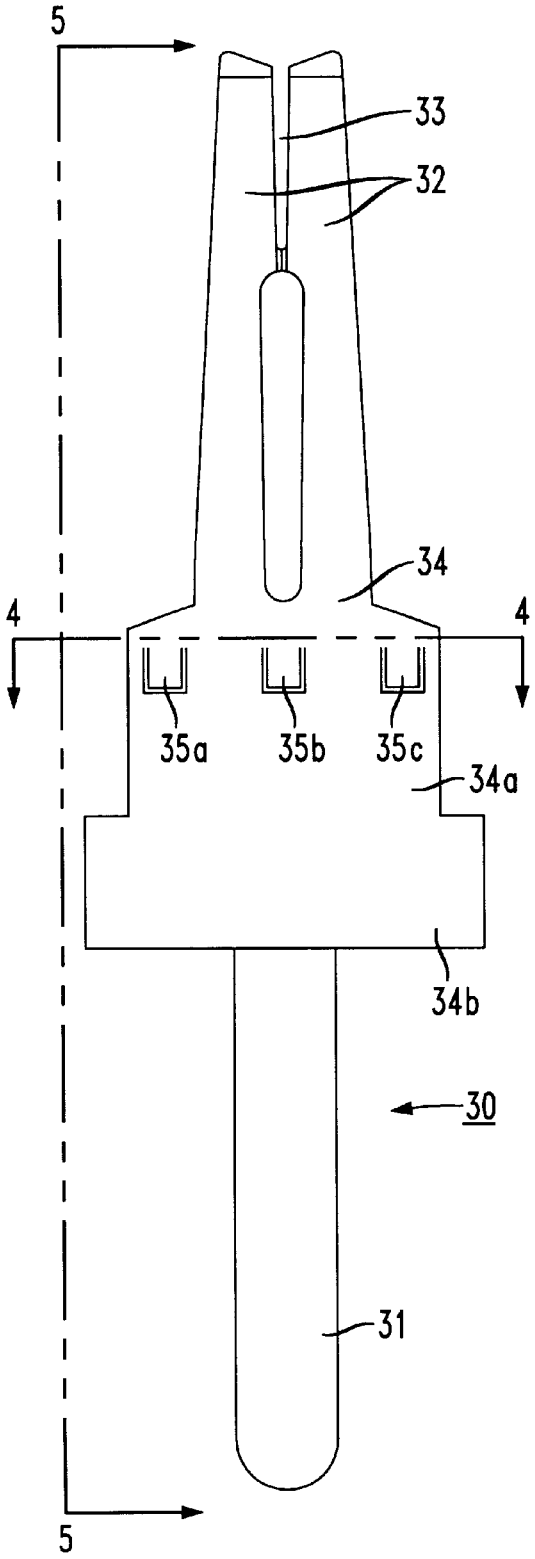
FIG. 3 is a front elevational view of the present invention illustrating the tabs on the surface of the terminal.
Figure 4:
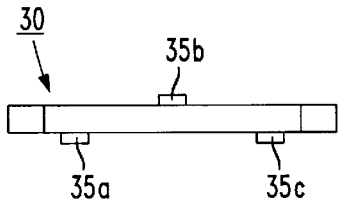
FIG. 4 is a view of the present invention illustrating the protrusion of the tabs from both surfaces of the terminals, taken along line 4—4 in FIG. 3.
Figure 5:
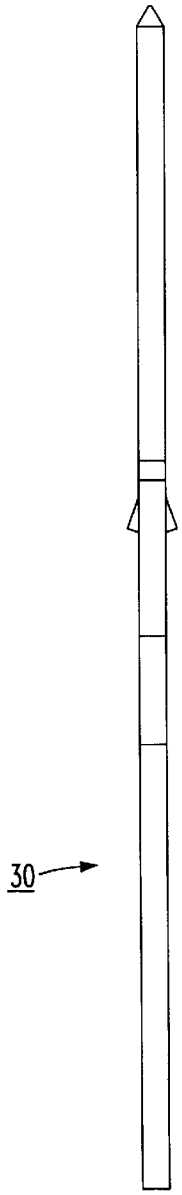
FIG. 5 is a side view of the present invention illustrating the protrusion of the tabs from both surfaces of the terminals, taken along line 5—5 in FIG. 3.

The present invention, insulation displacement connector (IDC) terminal 30, as shown in FIG. 3, having a post 31 for wire wrap connection on one end and a pair of cantilever beams 32, defining an elongated slot 33 therebetween for snubbing and seating of wires, on the opposite end. Terminal 30 is made of an electrically conducting material. The body 34 of terminal 30 has a narrower portion 34*a* and a wider portion 34*b*. A plurality of tabs 35, indicated as 35*a*, 35*b* and 35*c*, protrude from the surface of body 34. As shown in FIGS. 4 and 5, the outer two horizontally aligned, spaced apart stamped out tabs 35*a* and 35*c* extend away from one surface of body 34, while the center tab 35*b* extends away from the opposite surface of body 34.

FIGS. 6A and 6B illustrate the insertion of terminal 30 into housing 20. Entry slot 21 of housing 20 is dimensioned to fit a prior art terminal without tabs 35. As shown in FIG. 6A, tabs 35 flex towards the surface of the terminal during insertion of terminal 30 through entry slot 21 and, at the same time, cause terminal 30 to arch. The flexibility of tabs 35 and terminal 30 prevents the deformation of the walls of entry slot 21 of housing 20 caused by prior art terminal 10 having side barbs 17.

Upon full insertion and clearing of entry slot 21, as shown in FIG. 6B, terminal 30 returns to its original flattened state and tabs 35*a*, 35*b* and 35*c* unflex, wedging terminal 30 at entry slot 21 and within housing 20. Wider portion 34*a* of body 34 engages tongues 22 of housing 20*b* to prevent over insertion of terminal 30.

Figure 7:
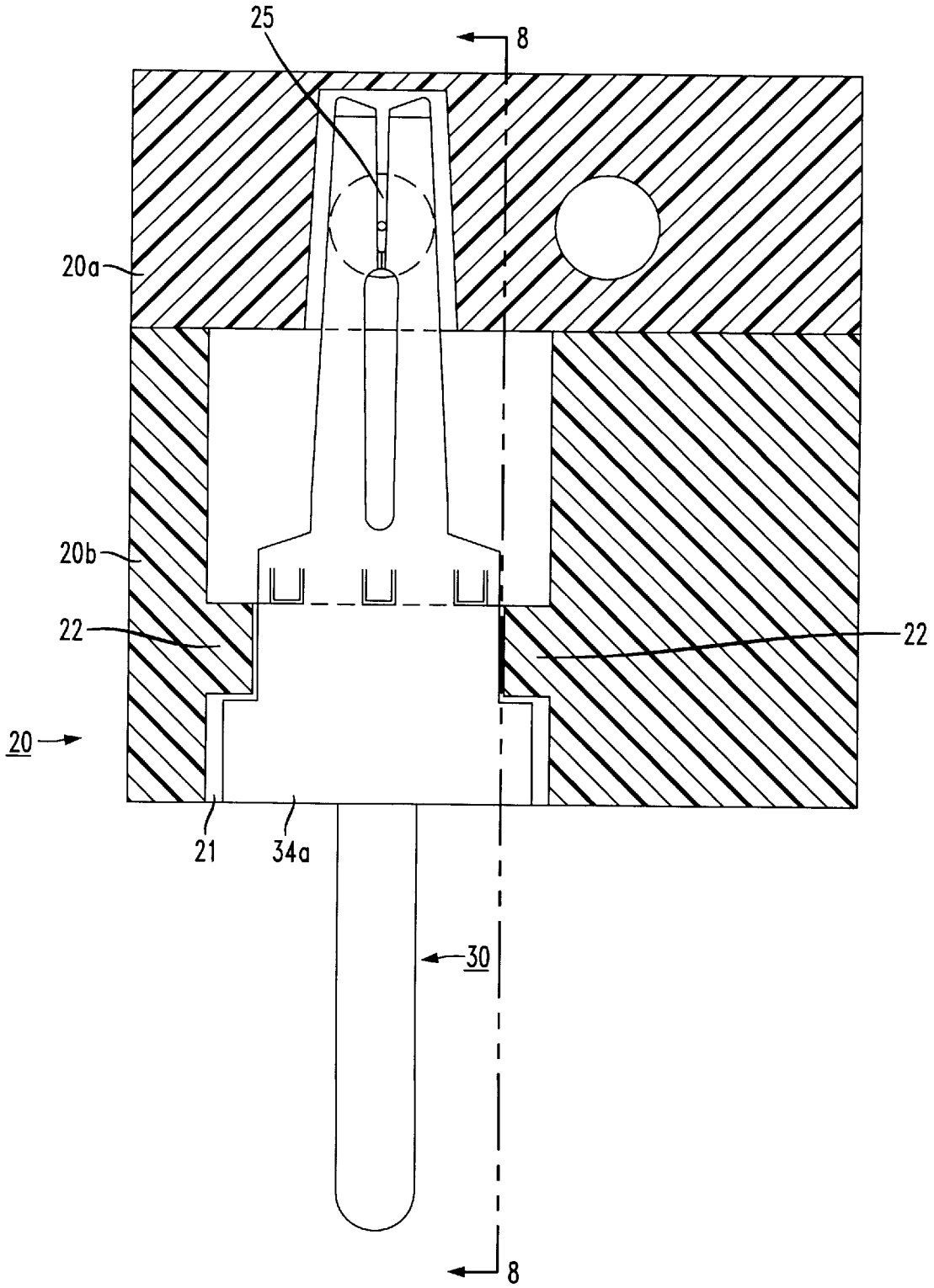
FIG. 7, is a cross-sectional view of a cooperative housing with the present invention utilizing protruded tabs to secure it within the housing.
Figure 8:
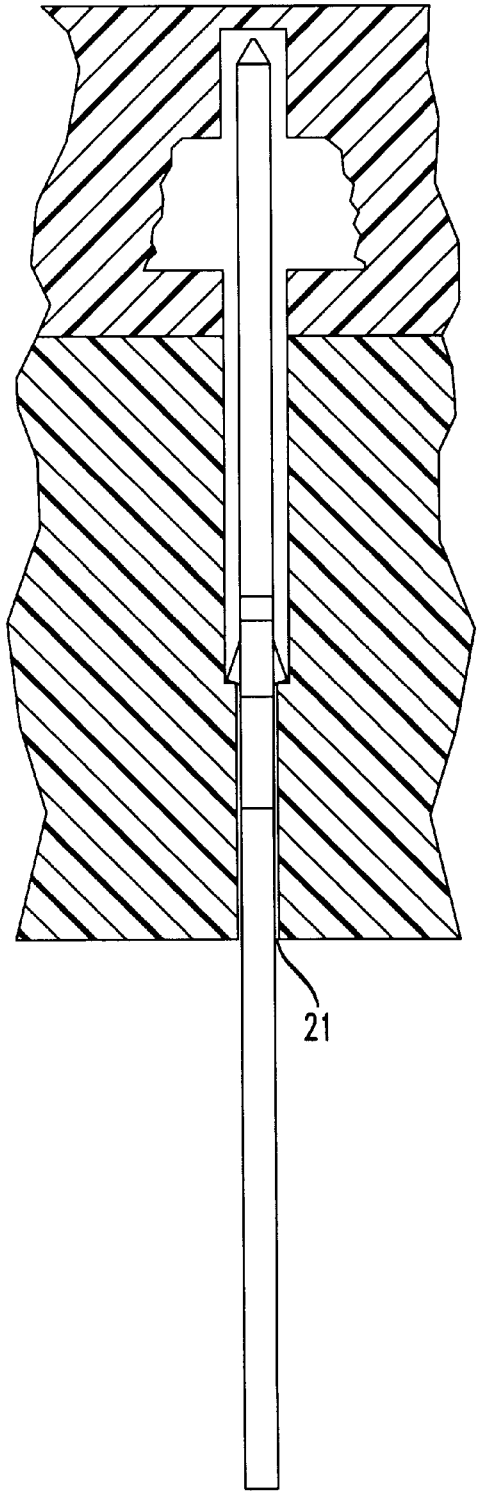
FIG. 8 is a cross-sectional view of a cooperative housing with the present invention illustrating the wedging of the protruded tabs against the entry slot of the housing, taken along line 8—8 in FIG. 7.

FIGS. 7 and 8 are two different views showing terminal 30 fully inserted within its cooperative housing 20. As shown in FIG. 8, tabs 35 securely wedge terminal 30 in housing 20 and prevent terminal 30 from displacement when wire 25 is being snubbed and seated on terminal 30. The retention provided by tabs 35 eliminate the need of a cooperative base 23. The assembly of inserting terminal 30 into housing 20 to achieve good retention is accomplished in an efficient and cost-effective manner.

The specification above discussed a terminal 30 having three tabs 35*a*, 35*b* and 35*c* protruding from opposite surfaces of body 34. However, more or less tabs, protruding from one or both surfaces of body 34 is contemplated and would not detract from the spirit of the invention.

Although certain features of the invention have been illustrated and described herein, other better modifications and changes will occur to those skilled in the art. It is, therefore, to be understood that the appended claims are intended to cover all such modification and changes that fall within the spirit of the invention.

What I claim is:

1. An insulation displacement connector terminal for insertion and retention within a cooperative housing, said housing having a longitudinal extending opening with a traverse entry slot, comprising:

(a) a planar body having opposite major surfaces being parallel to each other; and (b) at least two stamped out, spaced apart, tabs, at least one tab protruding from each of said major surfaces of said body, each of said tabs being deflected towards said surface when said terminal is inserted into said entry slot of said cooperative housing, and each of said tabs returning to its original protruded position upon full insertion of said terminal within said opening in said housing, thereby wedging said terminal within said housing.

2. The insulation displacement connector terminal according to claim 1, wherein said tabs being placed horizontally along said surface.

3. The insulation displacement connector terminal according to claim 2 wherein three of said tabs protrude from said body, two of said tabs protruding from one of said surfaces and one of said tabs protruding from said opposite surface.

4. The insulation displacement connector terminal according to claim 3, wherein said body and tabs are made of an electrically conducting material.

5. An insulation displacement connector terminal for insertion and retention within a cooperative housing, said terminal provides electrical contact between a first and second conductors, said housing having a longitudinal extending opening with a traverse entry slot, comprising:

(a) a planar body having opposite major surfaces and having first and second ends, said first end having a pair of cantilever beams defining an elongated slot therebetween for seating and snubbing said first conductor and said second end having a post for wire wrapping said second conductor;

(b) at least two horizontally aligned, stamped out, spaced apart, tabs, at least one tab protruding from each of said major surfaces of said body, each of said tabs being deflected towards said surface when said terminal is inserted into said slot of said cooperative housing, and each of said tabs returning to its original protruded position upon full insertion of said terminal within said opening in said housing, thereby wedging said terminal at said entry slot within said housing.

6. The insulation displacement connector terminal according to claim 2 wherein said body arches when said terminal is inserted into said entry slot of said cooperative housing, and said body returns to its original flattened state upon full insertion of said terminal within said housing.

7. The insulation displacement connector terminal according to claim 3, wherein said two tabs protruding from said one surface being spaced apart along said one surface and said one tab protruding from said opposite surface positioned between said two tabs.

* * * * *